US007641215B2

(12) United States Patent
Ellison

(10) Patent No.: US 7,641,215 B2
(45) Date of Patent: Jan. 5, 2010

(54) SKI AND SNOWBOARD EQUIPMENT SYSTEM

(76) Inventor: Matthew Wade Ellison, 5300 W. 116th Ave., Westminister, CO (US) 80020

( * ) Notice: Subject to any disclaimer, the term of this patent is extended or adjusted under 35 U.S.C. 154(b) by 116 days.

(21) Appl. No.: 11/679,019

(22) Filed: Feb. 26, 2007

(65) Prior Publication Data

US 2007/0200317 A1 Aug. 30, 2007

Related U.S. Application Data

(63) Continuation-in-part of application No. 11/483,837, filed on Jul. 10, 2006.

(60) Provisional application No. 60/778,076, filed on Feb. 28, 2006.

(51) Int. Cl.
*A63C 9/00* (2006.01)

(52) U.S. Cl. ..... 280/607; 280/608; 280/11.3; 280/611; 280/14.21

(58) Field of Classification Search ..... 280/607, 280/608, 11.3, 611, 14.21–14.24; 36/118.2, 36/118.4

See application file for complete search history.

(56) References Cited

U.S. PATENT DOCUMENTS

| | | | | | |
|---|---|---|---|---|---|
| 2,225,293 | A | | 12/1940 | Bjork | |
| 2,295,185 | A | | 9/1942 | Serr | |
| 2,361,030 | A | | 10/1944 | Hohmann | |
| 3,083,977 | A | | 4/1963 | Dunston | |
| 3,580,596 | A | | 5/1971 | Volkl | |
| 3,907,314 | A | | 9/1975 | Tanahashi | |
| 3,924,865 | A | * | 12/1975 | Benner | 280/608 |
| 4,756,099 | A | * | 7/1988 | Walkhoff | 36/118.8 |
| 5,462,304 | A | * | 10/1995 | Nyman | 280/609 |
| 5,675,917 | A | * | 10/1997 | Falguere et al. | 36/117.2 |
| 6,015,161 | A | * | 1/2000 | Carlson | 280/626 |
| 6,062,585 | A | * | 5/2000 | Hess | 280/608 |
| 2004/0080142 | A1 | * | 4/2004 | Hafer | 280/601 |
| 2007/0075523 | A1 | * | 4/2007 | Len | 280/602 |

OTHER PUBLICATIONS

International Search Report and Written Opinion issued in related PCT Patent Application Serial No. PCT/US07/62996, 9 pages, Feb. 28, 2007.

International Preliminary Examination Report issued in related PCT Patent Application Serial No. PCT/US07/62996, 9 pages, Feb. 28, 2007, 7 pages, Sep. 12, 2008.

Select File History from related U.S. Appl. No. 10/712,115, dated Apr. 7, 2005 to Oct. 10, 2006, 73 pages.

* cited by examiner

*Primary Examiner*—Lesley D Morris
*Assistant Examiner*—Katy Meyer
(74) *Attorney, Agent, or Firm*—Lathrop & Gage LLP

(57) ABSTRACT

Gliding board equipment systems and individual components are disclosed herein. A gliding board equipment system of one embodiment includes a gliding board, a boot having an upper cuff and a lower boot, and a binding selectively attaching the boot to the gliding board. The upper cuff of the boot defines opposed slots, and a respective pin passes through each slot to couple the upper cuff to the lower boot and allow the upper cuff to move laterally relative to the lower boot.

28 Claims, 14 Drawing Sheets

SKI AND SNOWBOARD EQUIPMENT SYSTEM

RELATED APPLICATIONS

This application claims priority to U.S. Provisional Patent Application Ser. No. 60/778,076, filed 28 Feb. 2006, and is a continuation-in-part application of U.S. patent application Ser. No. 11/483,837, filed 10 Jul. 2006, which claims priority to U.S. patent application Ser. No. 10/712,115, filed 13 Nov. 2003, the disclosures of which are incorporated herein by reference.

BACKGROUND

Prior art ski and snowboard boots are generally made of an upper cuff and a lower boot that are connected together to restrict a user's lateral movement. These boots can vary in forward flexibility and stiffness, and they have proven popular because lateral flexibility in a ski or snowboard boot would reduce the user's ability to quickly turn the ski or snowboard. When a user leans into a traditional boot, the whole boot and ski (or snowboard) move as a single unit; this may allow the user to easily turn at high speeds or in other circumstances where fast direction changes are needed.

People sliding (also referred to as "grinding") on rails and other objects with skis and snowboards is becoming increasingly popular.

SUMMARY

Gliding board equipment systems are disclosed herein. A system of one embodiment includes a gliding board, a boot having an upper cuff and a lower boot, and a binding selectively attaching the boot to the gliding board. The upper cuff defines opposed slots, and a respective pin passes through each slot to couple the upper cuff to the lower boot and allow the upper cuff to move laterally relative to the lower boot.

DETAILED DESCRIPTION

Figure 1A:
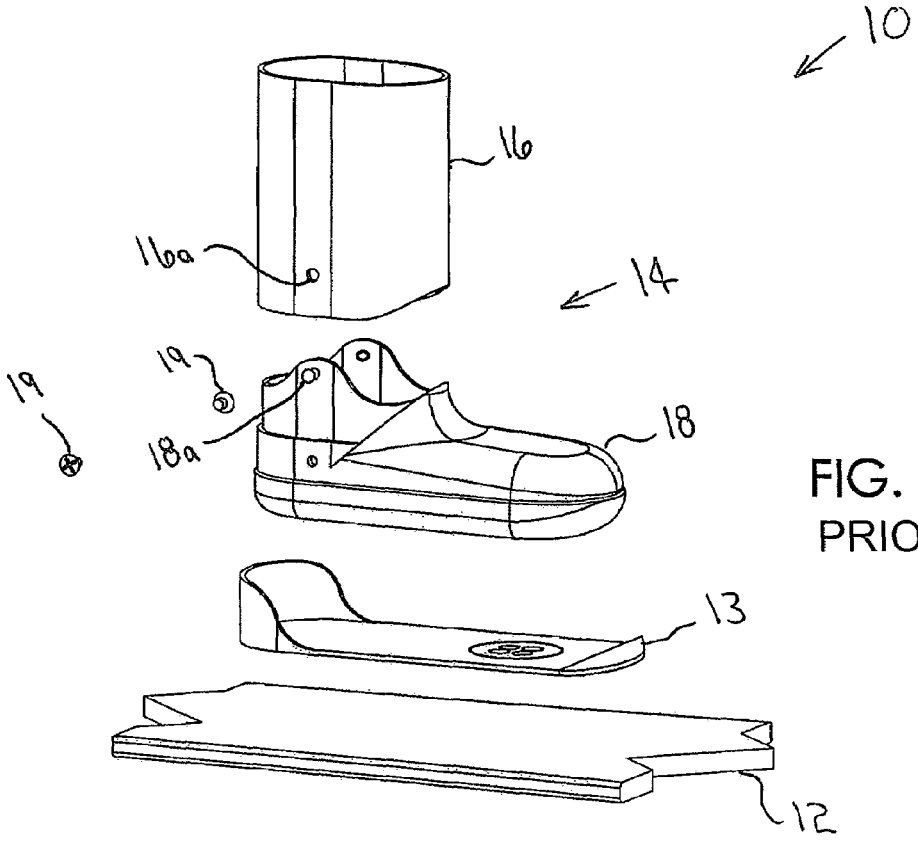
FIG. 1a PRIOR ART
FIG. 1*a* shows an exploded view of a prior art ski equipment system.
Figure 1B:
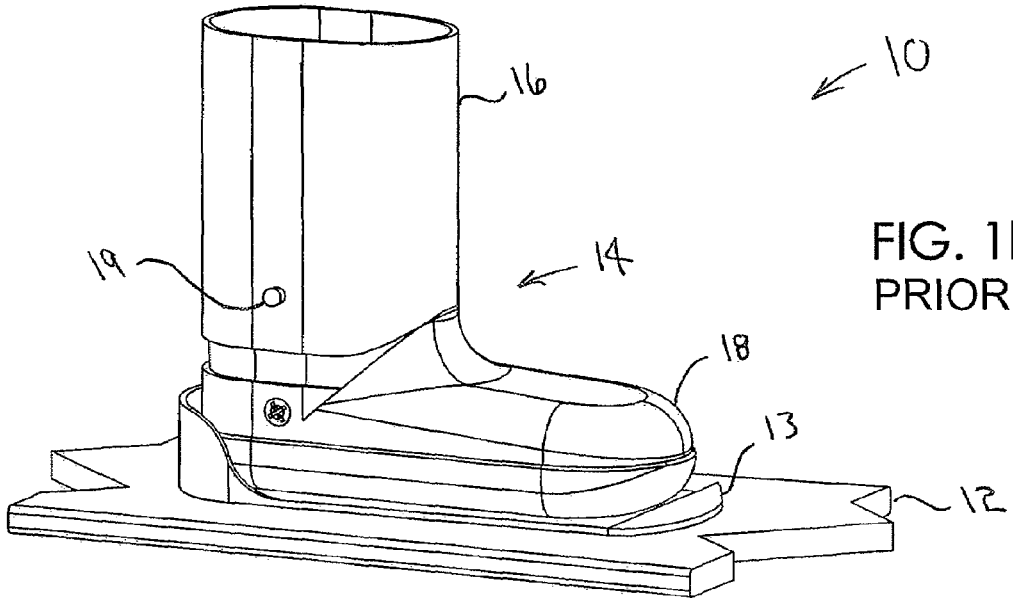
FIG. 1b PRIOR ART
FIG. 1*b* shows the prior art ski equipment system of FIG. 1*a* assembled.

FIGS. 1*a* and 1*b* show a prior art ski system 10. The system 10 includes a ski 12 and a boot 14 that has an upper cuff 16 attached to a lower boot 18. Pins 19 (e.g., rivets) travel through corresponding holes 16*a*, 18*a* in upper cuff 16 and lower boot 18 to allow limited movement (i.e., plantar flexion and dorsiflexion) between upper cuff 16 and lower boot 18. Lateral movement (i.e., inversion and eversion) is not allowed due to the manner of attaching upper cuff 16 and lower boot 18.

When a wearer leans into boot 14 laterally, the whole boot 14 and ski 12 move as a single unit. This may allow the wearer to easily turn at high speeds or in other circumstances where fast direction changes are needed. This does not allow a wearer to balance in different ways while sliding on objects, however. A binding 13 is shown to attach boot 14 to ski 12.

People sliding (also referred to as "grinding") on rails and other objects with skis and snowboards, which is becoming increasingly popular, may benefit from boots with lateral flexibility because the lateral flexibility may provide the users with the ability to balance in different ways while sliding on objects. A laterally "floating" cuff may allow the lower boot and the cuff to move more independently of each other, and with more ankle flexibility a rider may angle his body differently to get better sliding style or even to perform totally new tricks with different stances.

Figure 2A:
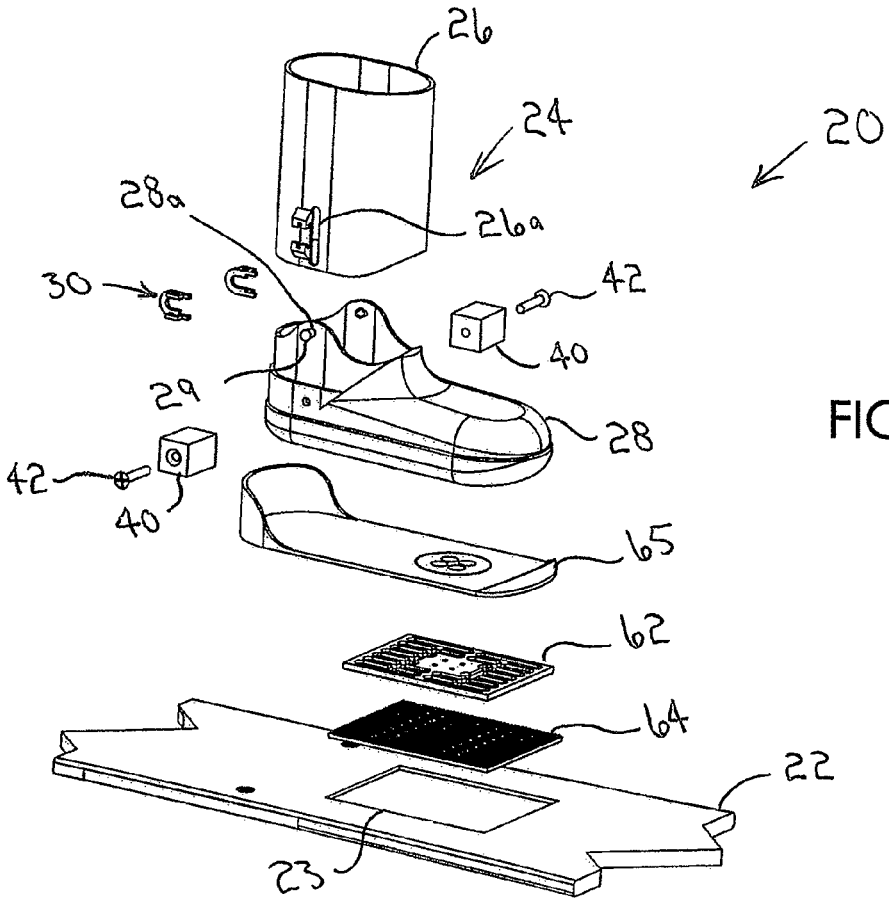
FIG. 2*a* shows an exploded view of a ski equipment system for terrain adaptability, according to an embodiment.
Figure 2B:
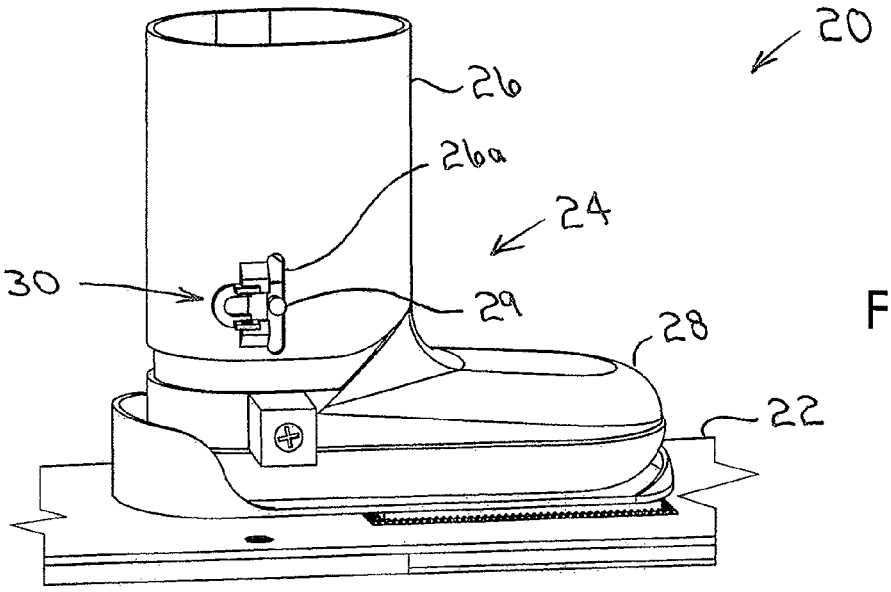
FIG. 2*b* shows the ski equipment system of FIG. 2*a* assembled.
Figure 3A:
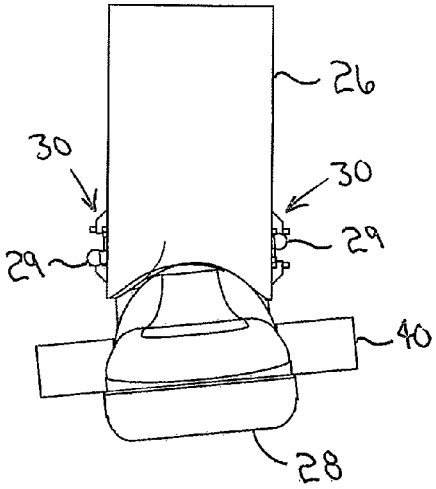
FIG. 3*a* shows an exemplary boot allowing inversion.
Figure 3B:
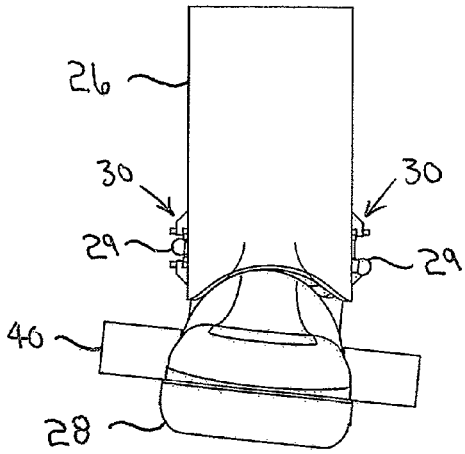
FIG. 3*b* shows the boot of FIG. 3*a* allowing eversion.
Figure 3C:
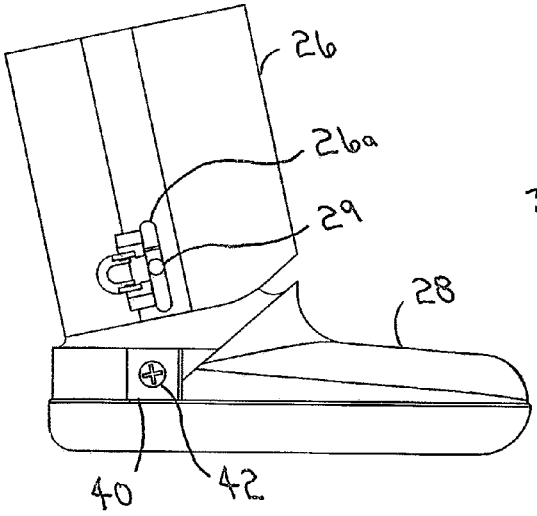
FIG. 3*c* shows the boot of FIG. 3*a* allowing plantar flexion.
Figure 3D:
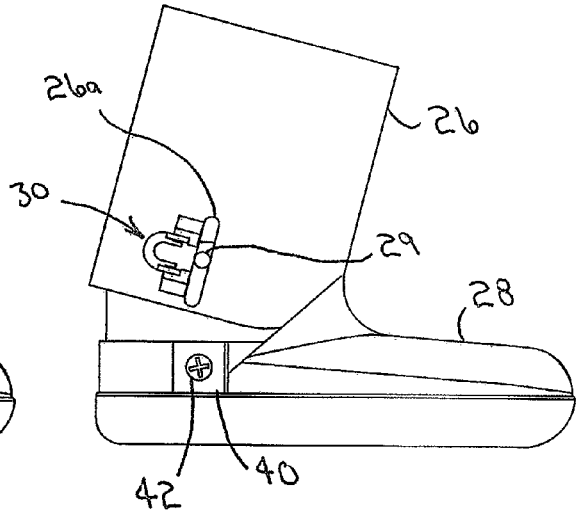
FIG. 3*d* shows the boot of FIG. 3*a* allowing dorsiflexion.

FIGS. 2*a* and 2*b* show a ski equipment system 20 for terrain adaptability according to an embodiment. System 20 includes a ski 22 and two boots 24. Each boot 24 has an upper cuff 26 attached to a lower boot 28. It should be understood that ski 22 may be substituted for a snowboard, and the term "gliding board" may be used to refer to either a ski or a snowboard. Though two boots 24 and two skis 22 may be included, only one boot 24 and one ski 22 are described in detail herein; the undescribed boot 24 and ski 22 are substantially a mirror images of the described boot 24 and ski 22, as is common in the art. Pins 29 (e.g., rivets) travel through corresponding slots 26*a* and holes 28*a* in upper cuff 26 and lower boot 28, respectively. More particularly, upper cuff 26 may define opposed slots 26*a*, and lower boot 28 may define opposed holes 28*a*; one pin 29 may couple one slot 26*a* to one hole 28*a*, and another pin 29 may couple another slot 26*a* to another hole 28*a*. When upper cuff 26 and lower boot 28 are attached in this manner, inversion (FIG. 3*a*), eversion (FIG. 3*b*), plantar flexion (FIG. 3*c*), and dorsiflexion (FIG. 3*d*) are allowed.

A boot that is always laterally flexible may perform poorly when the wearer uses the skis/snowboards traditionally (i.e., not to slide on objects,) however, since the lateral flexibility may not allow the user to easily turn at high speeds or in other circumstances where fast direction changes are needed.

Locks 30 may be positioned adjacent upper cuff slots 26*a* to selectively eliminate inversion and eversion or to selectively limit inversion and eversion. Locks 30 may be joined together so that locks 30 may be actuated jointly, or locks 30 may be separate (as shown throughout the drawings) so that locks 30 may be actuated individually.

A boot that is selectively laterally-flexible may be advantageous in that restricted lateral movement may be beneficial when skiing or snowboarding conventionally (i.e., not sliding on objects,) more lateral flexibility may be beneficial when sliding on objects with skis or snowboards, and the ability to adjust lateral flexibility may allow a user to switch between skiing/snowboarding conventionally and sliding on objects without changing boots.

Figure 4:
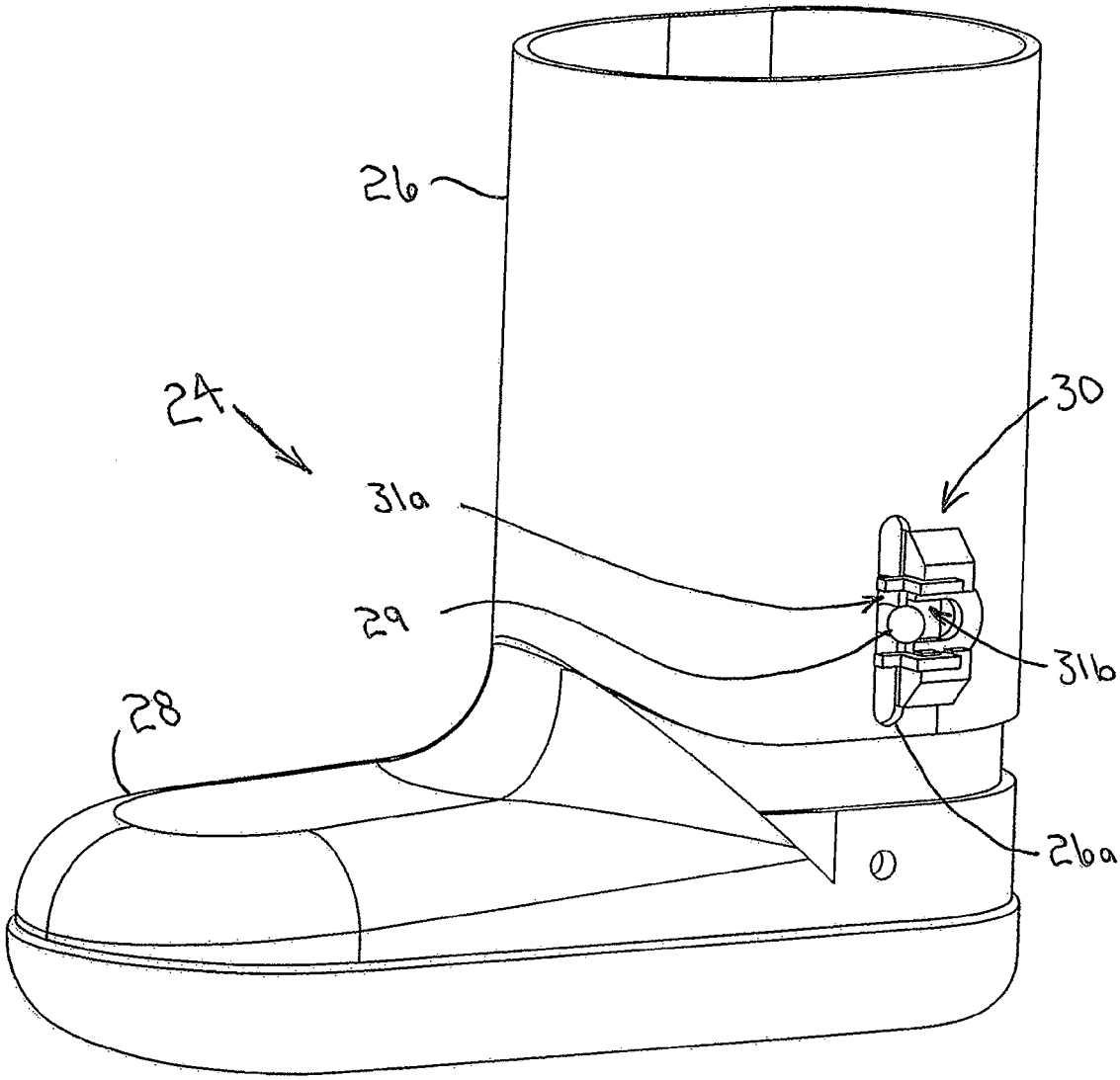
FIG. 4 shows an exemplary boot and lock from the ski equipment system of FIG. 2*b*.

FIG. 4 shows that each lock 30 may include a plurality of openings of various heights in communication with each other opening. Alternately, each lock 30 may include a single opening having a height slightly larger than a diameter of pin 29. Opening 31*a* is shown having a greater height than opening 31*b*. Heights of the openings are significant because they correspond to amounts of upper cuff slots 26*a* that remain uncovered when locks 30 are actuated, and in this way they may selectively restrict movement of pins 29. In other words, the amounts of upper cuff slots 26*a* that remain uncovered may determine the amount of lateral movement between upper cuff 26 and lower boot 28. Various ratcheting devices, spring biasing devices, clamping devices, and/or other devices may be incorporated with each lock 30 to allow the wearer to actuate locks 30.

Figure 5A:
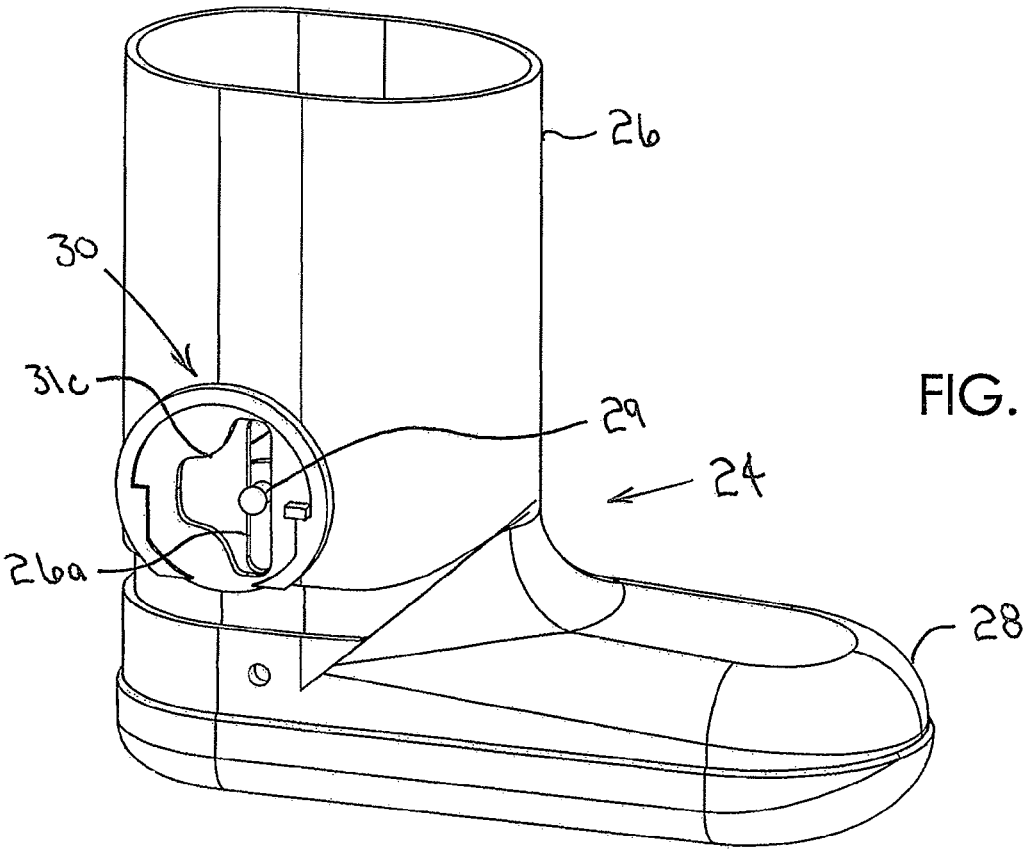
FIG. 5*a* shows the boot of FIG. 4 with a lock according to another embodiment.

FIG. 5*a* shows lock 30 according to another embodiment. More particularly, lock 30 may be rotatable instead of slidable, and an opening 31 c may selectively reveal predetermined amounts of upper cuff slots 26*a*.

Figure 5B:
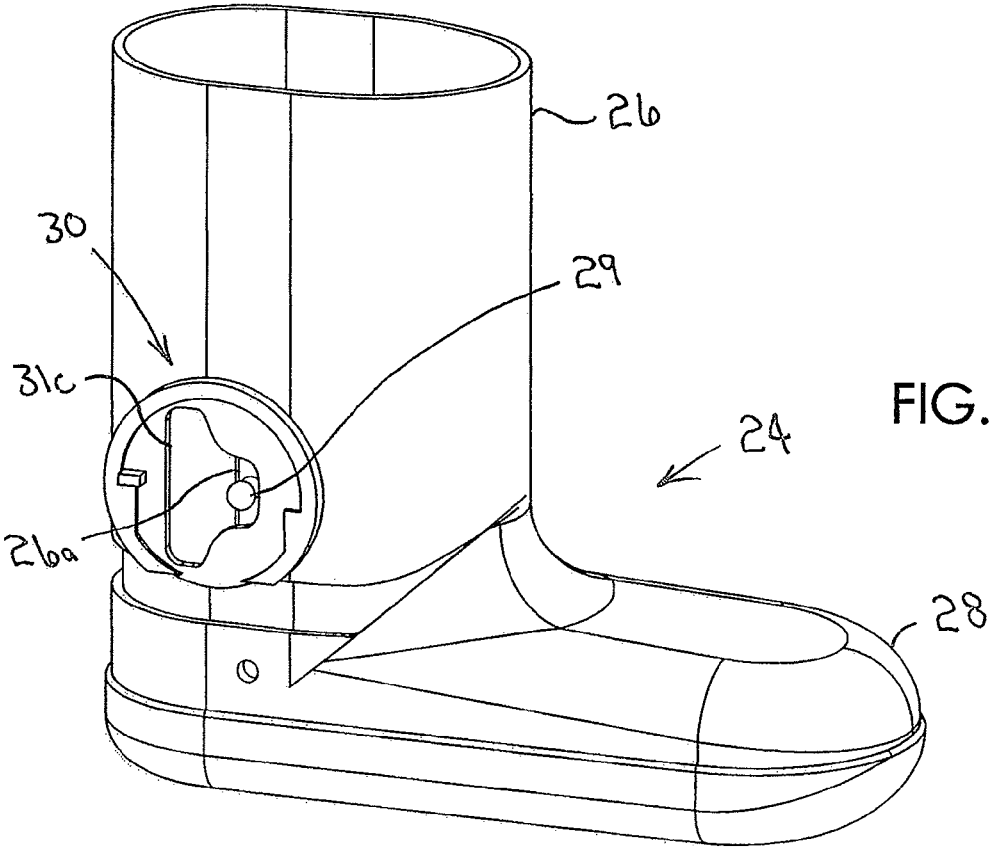
FIG. 5*b* shows the boot and lock of FIG. 5*a*, with the lock in another position.

FIG. 5*b* shows rotatable lock 30 as in FIG. 5*a* in a different position to allow less lateral movement between upper cuff 26 and lower boot 28 than when lock 30 is at the position shown in FIG. 5*a*.

Figure 6:
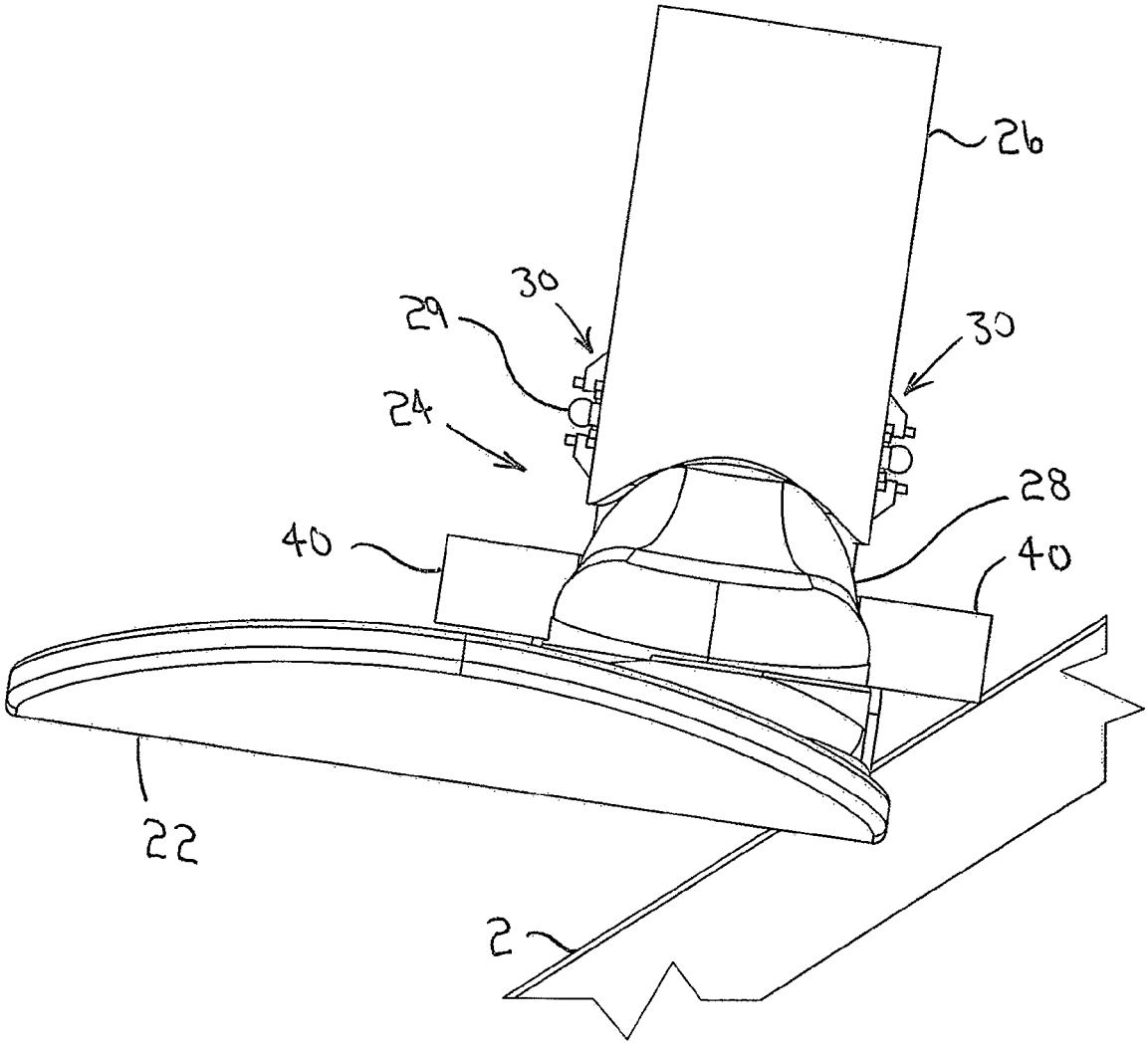
FIG. 6 shows an exemplary grind plate of FIG. 2*a* in use.

FIG. 6 and FIG. 2*b* show that one or more grind plate 40 may be attached to lower boot 28 to protect boot 24 from damage. Grind plate 40 may be removably coupled to lower boot 28 by a bolt 42 (FIG. 2*a*) or other fastener, or grind plate 40 may be fixedly attached to lower boot 28. Grind plate 40 may contact an object 2 that the wearer is sliding on, especially if the wearer is pivoting inwardly or outwardly on his ankles or if lock 30 is actuated to greatly restrict lateral movement (as shown in FIG. 6). It should be appreciated that grind plate 40 may be sized such that grind plate 40 will rarely contact a ground surface when lock 30 is actuated; this may allow a user to ski traditionally (with no interference from grind plate 40) when lock 30 is actuated. Contact between grind plate 40 and object 2 may keep boot 24 from contacting object 2, thereby avoiding damage to boot 24. Grind plate 40 may be replaced or discarded when damaged.

Figure 7:
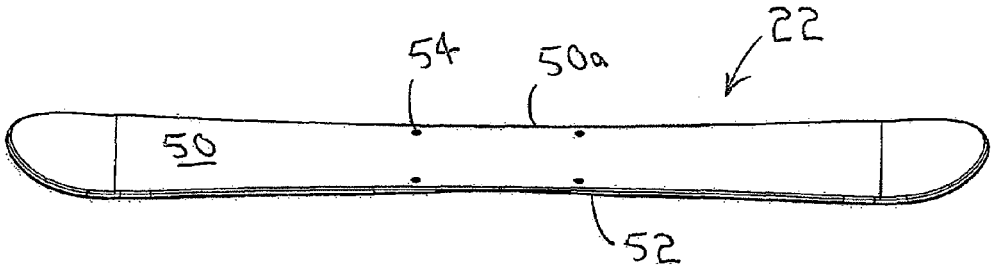
FIG. 7 shows an exemplary gliding board with a plurality of removable edge sections attached thereto.
Figure 8:
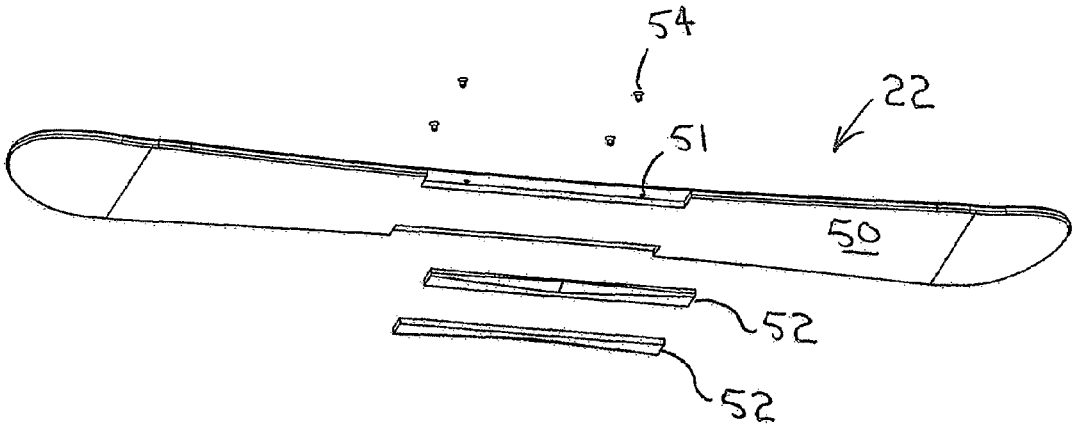
FIG. 8 shows an exploded view of the gliding board and removable edge sections of FIG. 7.

FIGS. 7 and 8 show a gliding board 22 with a board body 50 and a plurality of removable edge sections 52. The removable edge sections 52 are specifically designed to provide the optimal edges for conventional skiing and snowboarding, and, with a change of an edge section 52, the best edge for sliding or grinding. These edge sections 52 may be easily removed and replaced for a given activity or due to edge damage, and they may be constructed of metal, plastic, or composite materials, for example. The flexibility of edge sections 52 may be optimized depending on whether the user is skiing/snowboarding traditionally or sliding. For example, a gliding board 22 being used primarily for skiing/snowboarding traditionally may use edge sections 52 having a flexibility very close to that of the board 22, while a gliding board 22 being used primarily for sliding may use edge sections 52 that are more or less flexible than the board 22. Flexible edges may be desirable when a user wants the board 22 to conform to the shape of the object being slid upon. Edges that are not flexible may be desirable when a user is sliding on rough, high friction surfaces such as concrete, because by conforming less, the edge may reduce friction and allow for a better slide.

FIGS. 7 and 8 also show that bolts 54 may pass through openings 51 in board body 50 and attach edge sections 52 to board body 50. Bolts 54 may be tightened adjacent an upper edge 50*a* of board body 50 so that edge sections 52 may be pulled tightly to board body 50. Edge sections 52 may alternately be attached to board body 50 through bolts 54 that are not accessible from upper edge 50*a* (i.e., bolts 54 may pass through a side of edge sections 52,) tongue-and-groove fasteners, screws, clips, or other known fasteners.

Figure 9A:
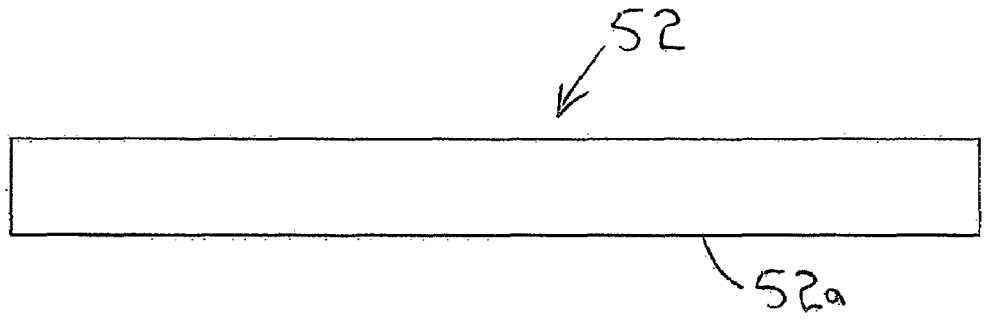
FIG. 9*a* shows an exemplary removable edge section having a traditional edge.

FIG. 9*a* shows a removable edge section 52 having a traditional (sharp and square) edge 52*a*. Edge 52*a* may work well for cutting into snow, but it may catch on obstacles that are being slid upon.

Figure 9B:
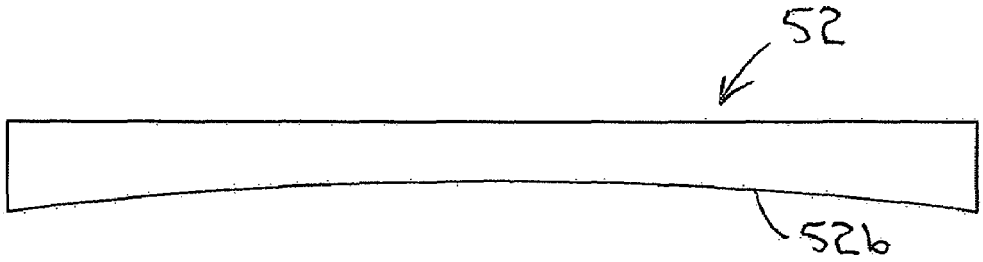
FIG. 9*b* shows an exemplary removable edge section having a beveled edge.

FIG. 9*b* shows a removable edge section 52 having a beveled edge 52*b*. Beveled edge 52*b* may allow gliding board 22 to "lock" onto an object, making it easier for a user to balance or slide on obstacles.

Figure 9C:
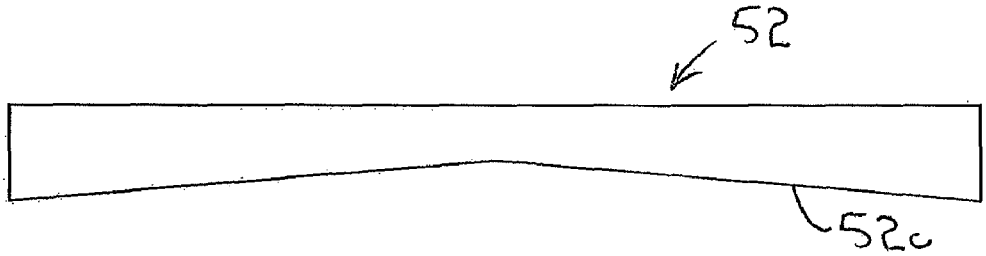
FIG. 9*c* shows an exemplary removable edge section having a notched edge.

FIG. 9*c* shows a removable edge section 52 having a notched edge 52*c*. Notched edge 52*c* is not as rounded as the beveled edge 52*b*, but it may also allow the gliding board 22 to "lock" onto an object, making it easier for a user to balance or slide on obstacles. Notched edge 52*c* and beveled edge 52*b* may provide different characteristics that different users prefer, and they each may be advantageous depending upon the object being slid upon.

Figure 9D:
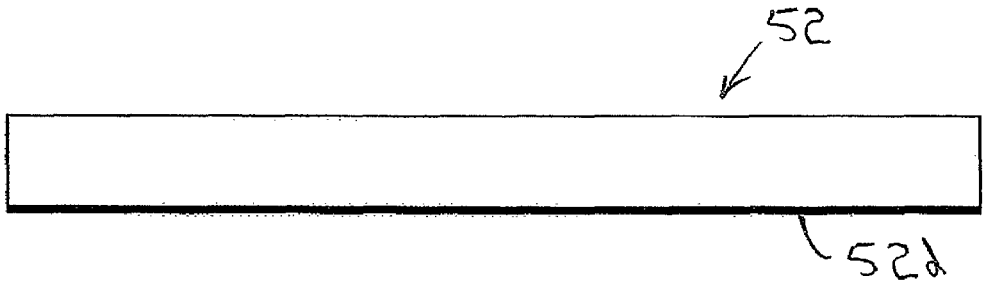
FIG. 9*d* shows an exemplary removable edge section having an intentionally dulled edge.

FIG. 9*d* shows a removable edge section 52 having an intentionally dulled edge 52*d*. Dulled edge 52*d* may provide a user with additional control, and it may slow the sliding of gliding board 22 across an object.

Figure 10:
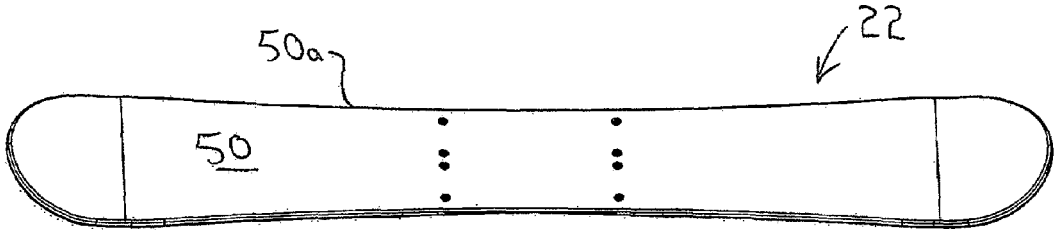
FIG. 10 shows an exemplary gliding board with a plurality of removable edge and base sections attached thereto.
Figure 11:
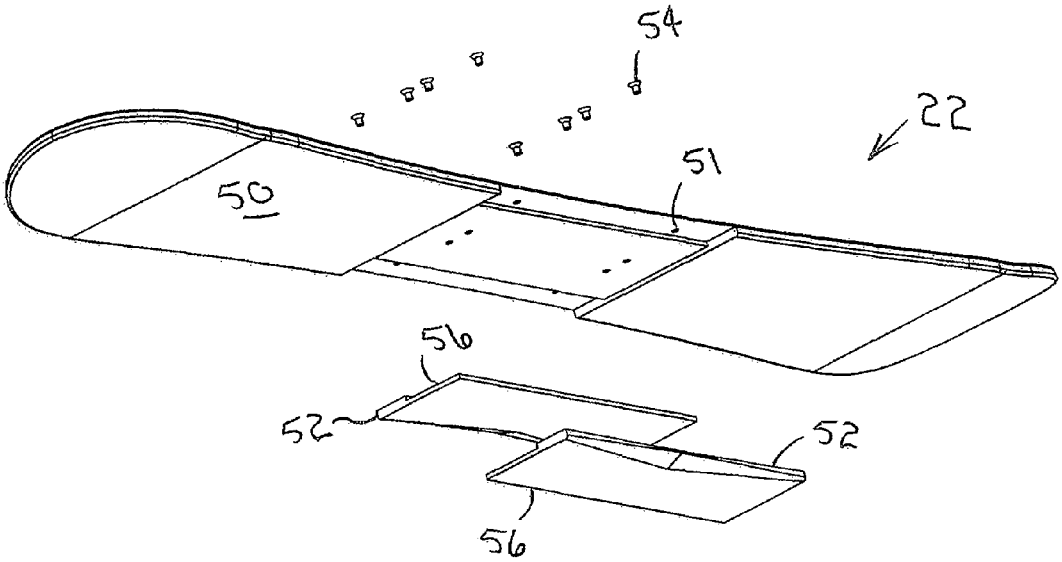
FIG. 11 shows an exploded view of the gliding board and removable edge and base sections of FIG. 10.

FIGS. 10 and 11 show a gliding board 22 with a plurality of removable edge and base sections 52, 56. This may be advantageous over the prior art because when edges 52 become damaged, especially due to rocks and rough terrain, the base of the board 22 is often damaged as well. Edge and base sections 52, 56 may be a single member as shown, or they may alternately be separate members. Edge sections 52 may be optimized depending on whether the user is skiing/snowboarding traditionally or sliding as discussed above, and edge sections 52 may have a variety of configurations, including those shown in FIGS. 9*a* through 9*d*. Base sections 56 may have a flexibility very close to that of the board 22, and bolts 54 may pass through openings 51 in board body 50 and attach edge and base sections 52, 56 to board body 50. Bolts 54 may be tightened adjacent upper edge 50*a* of board body 50 so that edge and base sections 52, 56 may be pulled tightly to board body 50. Edge and base sections 52, 56 may alternately be attached to board body 50 through bolts 54 that are not accessible from upper edge 50*a* (i.e., bolts 54 may pass through a side of edge sections 52,) tongue-and-groove fasteners, screws, clips, or other known fasteners.

Figure 12:
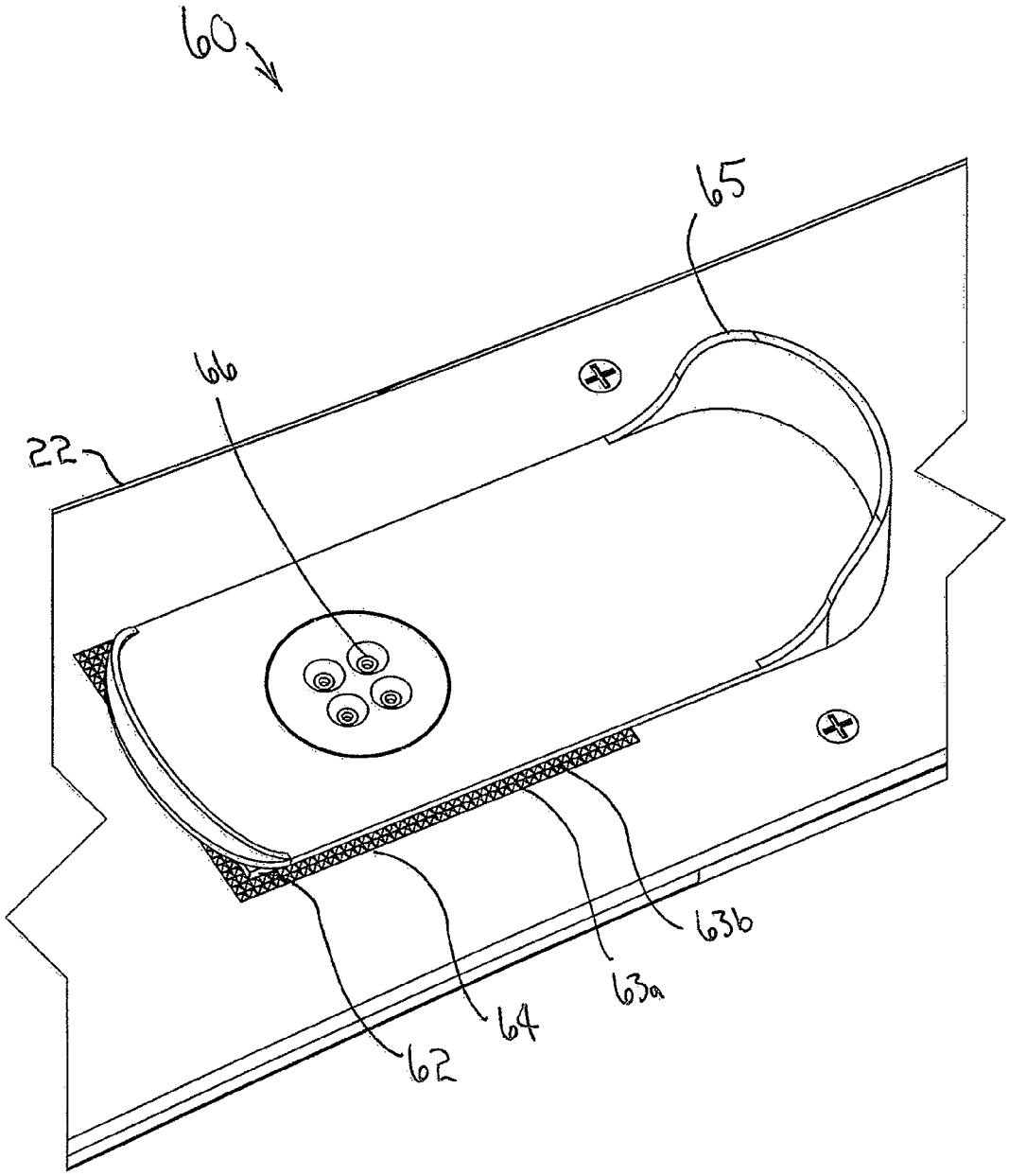
FIG. 12 shows an exemplary binding apparatus attached to a gliding board, according to one embodiment.

FIG. 12 shows a binding apparatus 60 that may be included in the ski equipment system 20. Bindings traditionally are used with skis and snowboards to attach a rider's boot to the ski/snowboard, and prior art bindings are not easily adjustable in relation to the ski/snowboard. Binding apparatus 60 may include top and bottom plates 62, 64, and a binding 65 may be attached to top plate 64 to extend upwardly therefrom, as shown. Top and bottom plates 62, 64 may be selectively coupled together (i.e., by bolts, screws, clamps, etc.), and each plate 62, 64 has a respective mating surface 62*a*, 64*a* (shown in FIG. 14) that may include complementary ridges and valleys 63*a*, 63*b* or a gripping texture (i.e., a durable rubber, etc.). Bottom plate 64 is shown attached to board body 50, and top plate 62 is shown attached to bottom plate 64 by bolts 66. Top plate 62 includes slots 67 (shown in FIG. 13) that allow top plate 62 to be adjusted relative to bottom plate 64 when bolts 66 are not tightened. Slots 67 may be configured to allow top plate 62 to be adjusted laterally, longitudinally, and/or at an angle relative to bottom plate 64. Top and bottom plates 62, 64 may each have a vertical flexibility similar to that of board 22 to minimize the effects of plates 62, 64 on the vertical flexibility of board 22. However, plates 62, 64 may be laterally rigid to provide optimal energy transfer from a user's boot 24 to board 22. It should also be appreciated that plates 62, 64 may be both vertically rigid and laterally rigid. Other bindings 65 available on the market may also be used.

Though not shown, top and bottom plates 62, 64 may be coupled by a tongue and groove system, and a locking mechanism (e.g., a high tension spring) may be used to maintain top and bottom plates 62, 64 at a chosen adjustment configuration. Top and bottom plates 62, 64 may also be coupled by a worm gear (e.g., a screw or bolt), and adjusting the worm gear may force top plate 62 to move relative to bottom plate 64. Other coupling devices that allow top plate 62 to be adjusted relative to bottom plate 64 may also be utilized.

Figure 13:
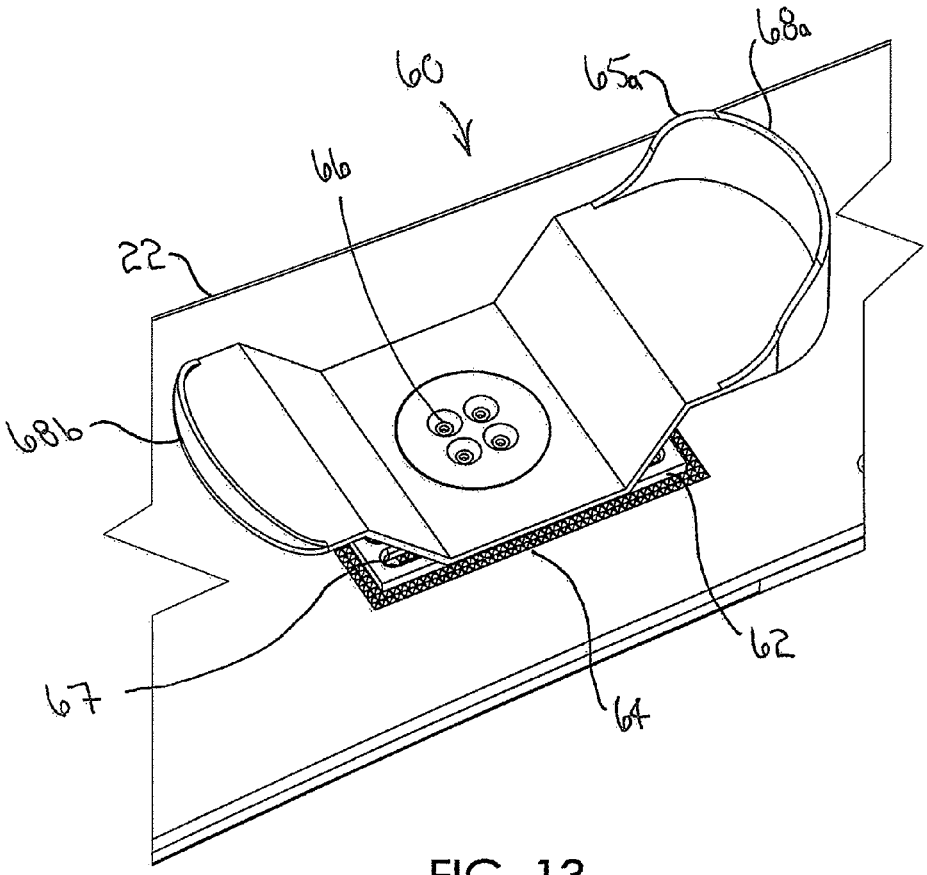
FIG. 13 shows another exemplary binding apparatus attached to the gliding board of FIG. 12.

FIG. 13 shows binding apparatus 60 as in FIG. 12 with an alternate binding 65*a*. Alternate binding 65*a* has heel and toe sections 68*a*, 68*b* that are raised from board 22. Raised heel and toe sections 68*a*, 68*b* may allow board 22 to flex vertically more naturally than if heel and toe sections 68*a*, 68*b* were directly atop board 22.

Figure 14:
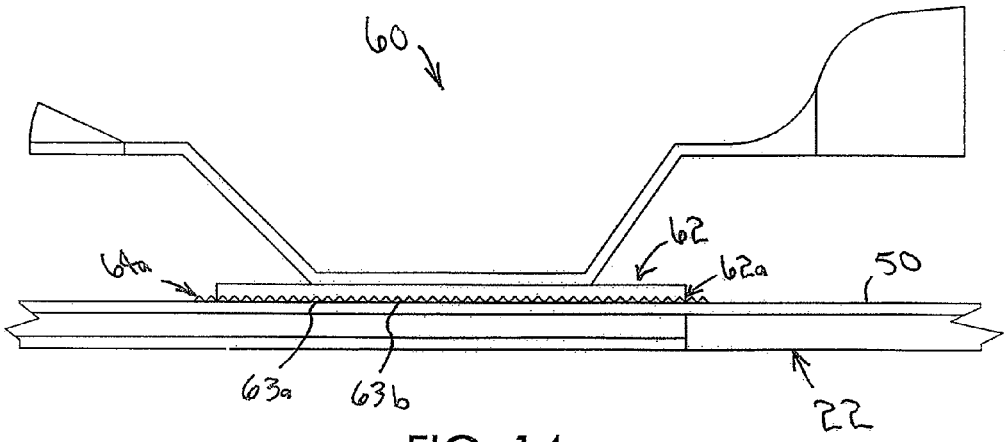
FIG. 14 shows the exemplary binding apparatus of FIG. 13 attached to a gliding board that has a bottom plated mounted inside a recess.

FIG. 14 shows binding apparatus 60 as in FIG. 13 with bottom plate 64 mounted inside a recess 23 (as in FIG. 2*a*) in board 22. By mounting bottom plate 64 in this manner (so that a bottom surface and sides of bottom plate contact board 22,) bottom plate 64 can be extremely securely connected to board 22.

Figure 15:
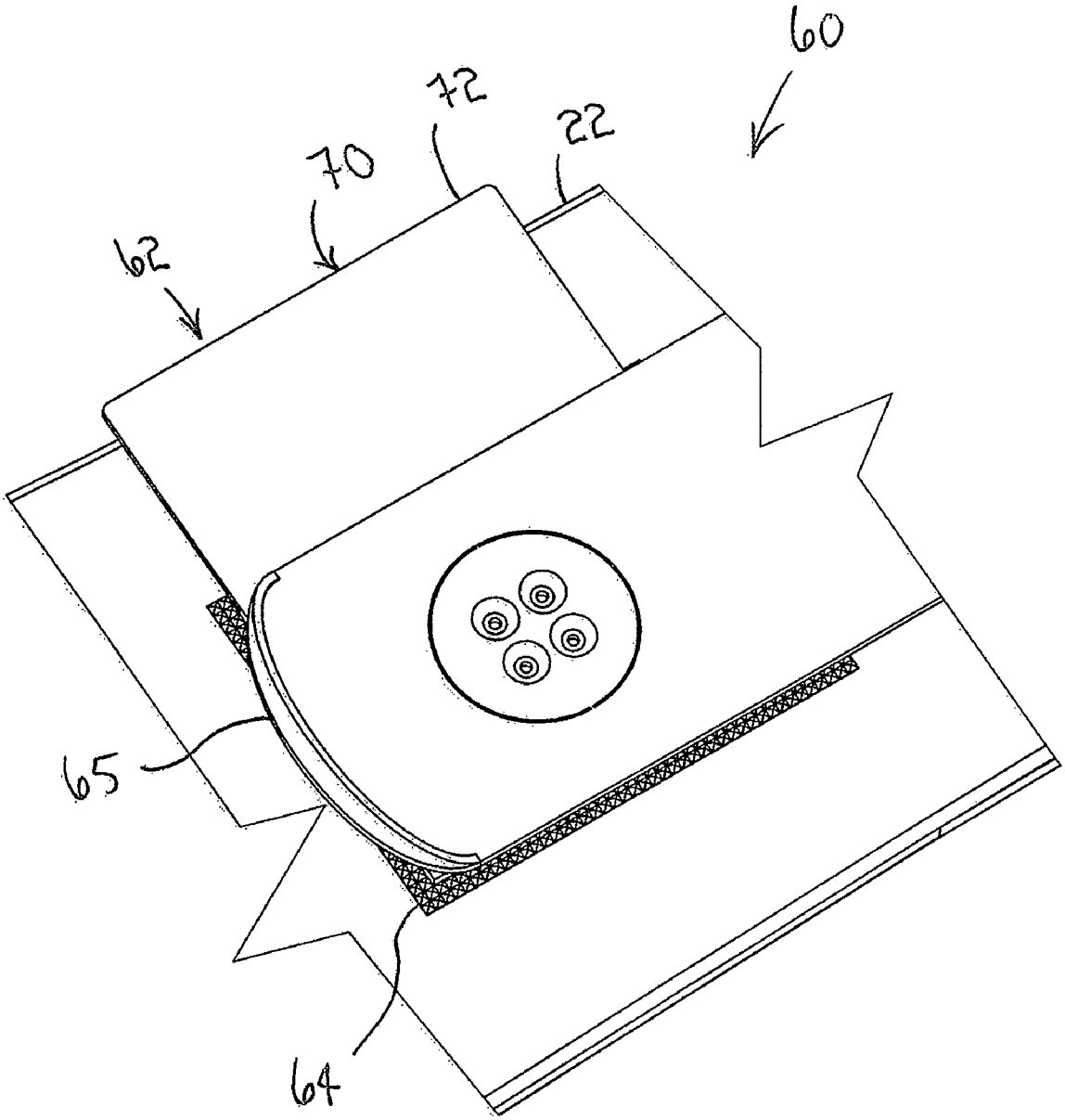
FIG. 15 shows an exemplary top plate that includes a grinding extension.

FIG. 15 shows binding apparatus 60 as in FIG. 14 with top plate 62 having a grinding extension 70. Grinding extension 70 is sized to extend beyond an edge of board 22, and grinding extension 70 includes an edge 72 specifically designed for sliding. Edge 72 may be constructed of metal, plastic, or composite materials, for example, and edge 72 may have a flexibility chosen for particular applications as discussed above in relation to FIGS. 7 and 8. Edge 72 may have a variety of configurations, including configurations similar to those shown if FIGS. 9*a* through 9*d*. Sliding on grinding extension 70 may allow a user to perform tricks not previously possible.

Figure 16:
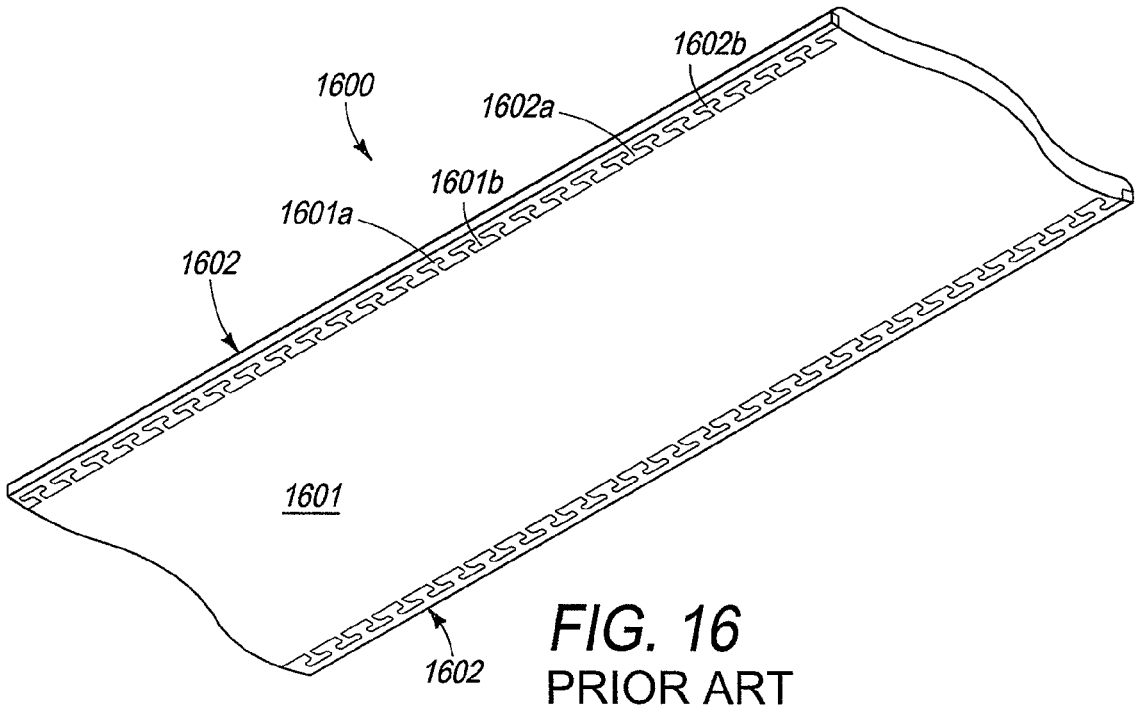
FIG. 16 PRIOR ART
FIG. 16 shows a section of a prior art gliding board.

FIG. 16 shows a section of a prior art gliding board 1600 having a main body 1601 and left and right edges 1602. Main body 1601 has keys 1601*a* and keyways 1601*b*, and each edge 1602 has keys 1602*a* and keyways 1602*b*. Keys 1601*a*, 1602*a* and keyways 1601*b*, 1602*b* collectively form tongue-and-groove assemblies to couple edges 1602 to main body 1601. When a respective edge 1602 is broken, it will typically continue to pull away from the main body 1601 from the break point.

Figure 17:
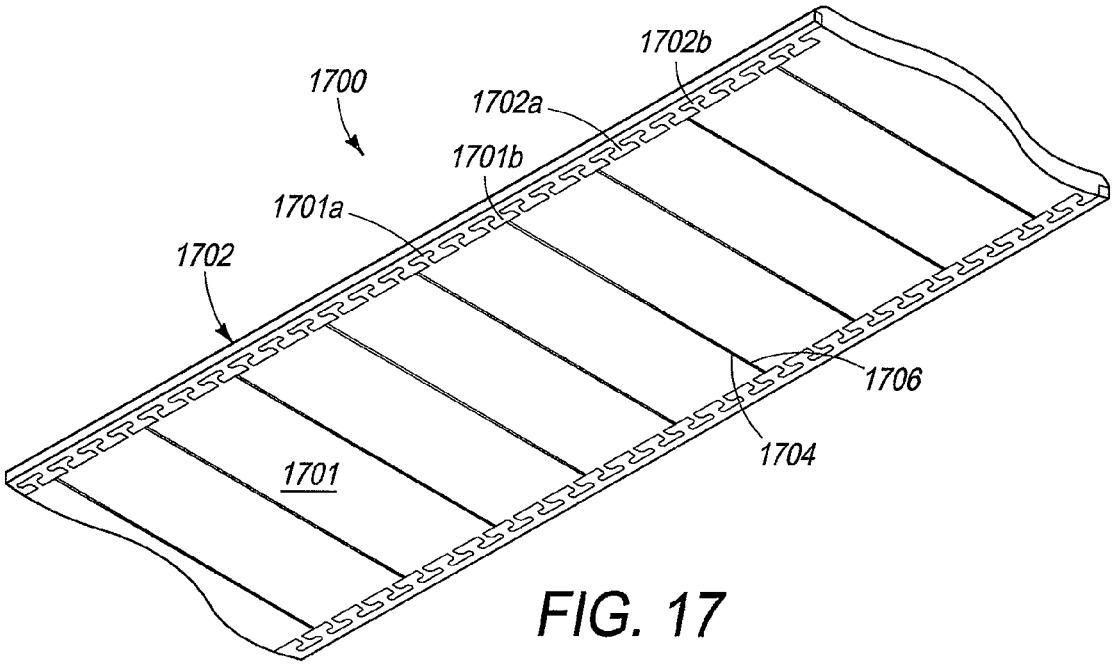
FIG. 17 shows a section of a gliding board according to an embodiment.

FIG. 17 shows a section of a gliding board 1700 according to an embodiment. Gliding board 1700 has a main body 1701 and left and right edges 1702. Main body 1701 has keys 1701*a* and keyways 1701*b*, and each edge 1702 has keys 1702*a* and keyways 1702*b*. Keys 1701*a*, 1702*a* and keyways 1701*b*, 1702*b* collectively form tongue-and-groove assemblies to couple edges 1702 to main body 1701 in a permanent or removable manner. Main body 1701 may define channels (or grooves) 1704, and connector members 1706 may pass through channels 1704 and couple left and right edges 1702 together. While connector members 1706 are shown attached to every third edge key 1702*a*, more or fewer connector members 1706 may be used. When a respective edge 1702 is broken, connector members 1706 may hold the broken edge 1702 in place against main body 1701.

Those skilled in the art appreciate that variations from the specified embodiments disclosed above are contemplated herein. The description should not be restricted to the above embodiments, but should be measured by the following claims.

What is claimed is:

1. A gliding board equipment system, comprising: a gliding board; a boot having an upper cuff and a lower boot, the upper cuff defining opposed slots, a respective pin passing through each slot to couple the upper cuff to the lower boot and allow the upper cuff to move laterally relative to the lower boot; and a binding selectively attaching the boot to the gliding board; wherein the boot further comprises a respective lock adjacent each slot for selectively covering a predetermined amount of each respective slot; wherein at least one of said locks is rotatable relative to the respective pin; and wherein the rotatable lock includes an opening for selectively revealing predetermined amounts of the respective slot.

2. The system of claim 1, wherein the locks are joined together to allow each respective lock to cover a similar predetermined amount of each respective slot simultaneously.

3. The system of claim 1, wherein each lock includes a plurality of openings of various heights in communication with each other opening, each opening being positionable adjacent a respective slot to allow a respective predetermined amount of the respective slot to remain uncovered.

4. The system of claim 1, wherein a respective actuating mechanism selected from the group consisting of a ratcheting device, a spring biasing device, and a clamping device is adjacent each respective lock to selectively actuate each respective lock.

5. The system of claim 1, wherein at least one grind plate is coupled to the lower boot.

6. The system of claim 1, wherein at least one grind plate is removably coupled to the lower boot.

7. A gliding board equipment system, comprising: a gliding board having board body and a plurality of edge sections, each edge section being removable from and replaceable to the board body; a boot having an upper cuff and a lower boot, the upper cuff defining opposed slots, a respective pin passing through each slot to couple the upper cuff to the lower boot and allow the upper cuff to move laterally relative to the lower boot; and a binding selectively attaching the boot to the gliding board; wherein the boot further comprises a respective lock adjacent each slot for selectively covering a predetermined amount of each respective slot; wherein at least one of said locks is rotatable relative to the respective pin; and wherein the rotatable lock includes an opening for selectively revealing predetermined amounts of the respective slot.

8. The system of claim 7, wherein the respective edge sections vary in flexibility.

9. The system of claim 7, wherein:

the board body has an upper surface and defines a plurality of holes extending from the upper surface through the board body; and a plurality of bolts extend through the plurality of holes and are accessible adjacent the upper surface to selectively couple the respective edge sections to the board body.

10. The system of claim 7, wherein each respective edge section has an edge selected from the group consisting of a square edge, a beveled edge, a notched edge, and a dulled edge.

11. The system of claim 7, wherein the gliding board includes at least one connector member for spanning the board body and coupling one respective edge section to another respective edge section.

12. The system of claim 1, wherein the gliding board includes a board body, left and right edge sections respectively coupled to the board body, and at least one connector member coupling the left edge section with the right edge section.

13. A gliding board equipment system, comprising: a gliding board having a board body and a plurality of edge sections and base sections, each edge section and base i section being removable from and replaceable to the board body; a boot having an upper cuff and a lower boot, the upper cuff defining opposed slots, a respective pin passing through each slot to couple the upper cuff to the lower boot and allow the upper cuff to move laterally relative to the lower boot; and a binding selectively attaching the boot to the gliding board; wherein the boot further comprises a respective lock adjacent each slot for selectively covering a predetermined amount of each respective slot; wherein at least one of said locks is rotatable relative to the respective pin; and wherein the rotatable lock includes an opening for selectively revealing predetermined amounts of the respective slot.

14. The system of claim 13, wherein the respective base sections have a flexibility substantially similar to a flexibility of the board body.

15. The system of claim 13, wherein:

the board body has an upper surface and defines a plurality of holes extending from the upper surface through the board body; and a plurality of bolts extend through the plurality of holes and are accessible adjacent the upper surface to selectively couple the respective edge sections and base sections to the board body.

16. The system of claim 13, further including at least one fastener selected from the group consisting of a bolt, a screw, a clip, and a tongue-and-groove for mounting a respective edge section and a respective base section to the board body.

17. The system of claim 13, wherein each respective edge section has an edge selected from the group consisting of a square edge, a beveled edge, a notched edge, and a dulled edge.

18. The system of claim 1, further comprising a top plate coupled to the binding and a bottom plate coupled to the gliding board, the top and bottom plates being coupleable in various configurations to allow the top plate to be adjusted relative to the bottom plate.

19. The system of claim 18, wherein:

the top plate has top surface and a mating surface and defines a slot extending from the top plate top surface through the top plate;

the bottom plate has a mating surface complementary to the top plate mating surface;

the top plate mating surface is positionable upon the bottom plate mating surface; and a bolt extends through the top plate slot and is accessible adjacent the top plate top surface to selectively couple the top and bottom plates.

20. The system of claim 19, wherein:

the top plate mating surface includes ridges and valleys; and the bottom plate mating surface includes ridges and valleys complementary to the ridges and valleys of the top plate mating surface.

21. The system of claim 19, wherein:

the top plate mating surface includes a gripping texture; and the bottom plate mating surface includes a gripping texture.

22. The system of claim 18, wherein:

the top and bottom plates have a vertical flexibility similar to a vertical flexibility of the gliding board; and the top and bottom plates are laterally rigid.

23. The system of claim 19, wherein the binding has heel and toe sections that are raised above the top surface of the top plate.

24. The system of claim 18, wherein:

the gliding board defines a recess; and the bottom plate is mounted inside the gliding board recess so that a bottom surface and at least one side of the bottom plate contact the gliding board.

25. The system of claim 18, wherein:

the top plate includes a grinding extension sized to extend beyond an edge of the gliding board; and the grinding extension includes an edge for sliding on objects.

26. The system of claim 25, wherein the grinding extension edge is selected from the group consisting of a square edge, a beveled edge, a notched edge, and a dulled edge.

27. The system of claim 1, wherein: the gliding board includes a board body and a plurality of edge sections, each edge section being removable from and replaceable to the board body; a top plate is coupled to the binding and a bottom plate coupled to the gliding board, the top and bottom plates being coupleable in various configurations to allow the top plate to be adjusted relative to the bottom plate; the top plate includes a grinding extension sized to extend beyond an edge of the gliding board; and the grinding extension includes an edge for sliding on objects.

28. The system of claim 1, further comprising: a top plate coupled to the binding; a bottom plate coupled to the gliding board; and means for coupling the top and bottom plates to allow the top plate to be adjusted relative to the bottom plate.

* * * * *